US008297527B2

(12) United States Patent
Norman et al.

(10) Patent No.: US 8,297,527 B2
(45) Date of Patent: Oct. 30, 2012

(54) PORTABLE, FLEXIBLE, AND ADAPTABLE TRAIN SYSTEM

(75) Inventors: Casey W. Norman, Andoversford (GB); David Gamlin, Bath (GB); Tony Thatcher, Gillingham Dorset (GB)

(73) Assignee: Genie Toys plc (GB)

( * ) Notice: Subject to any disclaimer, the term of this patent is extended or adjusted under 35 U.S.C. 154(b) by 0 days.

(21) Appl. No.: 13/039,690

(22) Filed: Mar. 3, 2011

(65) Prior Publication Data

US 2011/0146529 A1 Jun. 23, 2011

Related U.S. Application Data

(62) Division of application No. 11/998,206, filed on Nov. 29, 2007, now Pat. No. 7,922,101.

(51) Int. Cl.
*E01B 23/00* (2006.01)

(52) U.S. Cl. ..... 238/10 R; 238/10 E

(58) Field of Classification Search ..... 238/10 R, 238/10 A, 10 E, 10 F; 446/444, 445, 446, 446/447

See application file for complete search history.

(56) References Cited

U.S. PATENT DOCUMENTS

| | | | | |
|---|---|---|---|---|
| 2,026,181 | A | 12/1935 | Kennedy | |
| 2,153,983 | A | 4/1939 | Kelch et al. | |
| 2,832,426 | A | 4/1958 | Seargeant | |
| 2,895,429 | A | 7/1959 | Baermann | |
| 3,494,070 | A * | 2/1970 | Lemelson | 446/138 |
| 4,151,679 | A | 5/1979 | Tanaka | |
| 4,221,076 | A | 9/1980 | Ozawa | |
| RE30,454 | E | 12/1980 | Birdsall | |
| 4,241,875 | A | 12/1980 | Vandenbrink | |
| 4,429,488 | A | 2/1984 | Wessels | |
| 4,496,100 | A * | 1/1985 | Schwager et al. | 238/10 R |
| 4,540,119 | A * | 9/1985 | Neuhierl | 238/10 R |
| 4,799,916 | A | 1/1989 | McKay et al. | |
| 4,941,610 | A * | 7/1990 | Frauca | 238/10 A |
| 5,308,274 | A | 5/1994 | Watrobka et al. | |
| 5,579,997 | A * | 12/1996 | Jackson et al. | 238/10 R |
| 5,779,145 | A * | 7/1998 | Zelle et al. | 238/10 E |
| 6,089,952 | A | 7/2000 | Dowd et al. | |
| 6,382,519 | B1 * | 5/2002 | Choi | 238/10 R |
| 6,398,121 | B1 * | 6/2002 | Morgan | 238/10 F |
| 6,572,434 | B2 | 6/2003 | Man | |

(Continued)

FOREIGN PATENT DOCUMENTS

| | | |
|---|---|---|
| DE | 20 45 467 | 3/1972 |

(Continued)

*Primary Examiner* — Jason C Smith
(74) *Attorney, Agent, or Firm* — DLA Piper LLP (US)

(57) ABSTRACT

A train system includes a track and at least one train component. Connectable and detachable segments join to form the track. Each segment includes a main body with an upper running surface upon which train components run. A receiving chamber is formed within the main body. A pair of track members extend outwardly from opposed sides of the main body. A connector component, with a neck portion and a distal portion, extends outwardly from the main body opposite the receiving chamber and engages the receiving chamber of another segment. The segments move in up-down and side-to-side directions. Each train component connects to the track by a pair of rail guides that engage the opposed sides of the main body. A spring element connected between the rail guides operates a switch element to drive a drive member, which engages the upper running surface to move the train component along the track.

11 Claims, 4 Drawing Sheets

U.S. PATENT DOCUMENTS

| | | | | |
|---|---|---|---|---|
| 6,631,850 | B1 * | 10/2003 | Wa | 238/10 F |
| 6,648,237 | B2 * | 11/2003 | Rothkopf et al. | 238/10 E |
| 6,695,219 | B1 * | 2/2004 | Fowler et al. | 238/10 B |
| 6,883,720 | B2 * | 4/2005 | D'Angelo et al. | 238/10 E |
| 7,051,948 | B2 * | 5/2006 | Wa | 238/10 E |
| 7,309,023 | B2 * | 12/2007 | Kaiser | 238/10 R |
| 7,722,427 | B2 * | 5/2010 | Yamana | 446/133 |
| 2004/0182947 | A1 * | 9/2004 | Wa | 238/10 R |
| 2006/0196961 | A1 * | 9/2006 | Belding | 238/10 R |
| 2008/0146115 | A1 * | 6/2008 | Yamana | 446/129 |
| 2009/0139424 | A1 * | 6/2009 | Norman et al. | 105/1.5 |
| 2011/0146529 | A1 * | 6/2011 | Norman et al. | 105/1.5 |

FOREIGN PATENT DOCUMENTS

| | | |
|---|---|---|
| EP | 1 849 508 | 10/2007 |
| JP | 2000-061154 | 2/2000 |
| WO | 03/068354 | 8/2003 |
| WO | WO 03068354 A1 * | 8/2003 |

* cited by examiner

PORTABLE, FLEXIBLE, AND ADAPTABLE TRAIN SYSTEM

RELATED APPLICATIONS

This is a divisional of U.S. patent application Ser. No. 11/998,206 filed Nov. 29, 2007, the subject matter of which is incorporated herein by reference.

TECHNICAL FIELD

This technical disclosure relates generally to a train system that is portable, flexible, and adaptable.

BACKGROUND

Trains and train tracks are widely used toys. Some tracks may require assembly of various pieces to form the track, while other tracks may be a formed structure. The tracks may not be flexible, portable, and/or adaptable. Trains may sit on top of, or otherwise connect to, the track. However, the trains may not operate if the track is misaligned.

A track system is desired that can be made up of individual segments that can be lengthened or shortened as desired, that can sit on uneven ground, or be aligned over bumps and around corners without reassembly and further can be picked up and stored intact and then replaced without reassembly.

SUMMARY

A portable, flexible, and adaptable train track system supports one or more train components. A plurality of segments connect to and detach from one another to form the track system. Each segment includes a main body that has an upper running surface that extends continuously across opposed sides upon which the one or more train components run. A receiving chamber is formed within the main body of each segment. A pair of track members outwardly extend from the opposed sides of the main body. A connector component outwardly extends from the main body opposite the receiving chamber. The connector component includes a necked portion that is proximate the main body and a distal portion sized larger than an opening of the receiving chamber. The distal portion engages the receiving chamber and allows movement of each segment in an up-down direction and a side-to-side direction.

A toy train system includes a track of a plurality of segments that connect to and detach from one another and at least one train component that connects to the track for movement thereon. Each segment that forms the track includes a main body with an upper running surface with opposed sides and a receiving chamber formed within the main body. A pair of track members extend outwardly from the opposed sides of the main body. A connector component extends outwardly from the main body opposite the receiving chamber and includes a necked portion proximate the main body and a distal portion sized larger than an opening of the receiving chamber that engages the receiving chamber and allows movement of each segment in an up-down direction and a side-to-side direction. The train component includes a drive member that engages the upper running surface of each segment, a switch element that when operated drives the drive member to move the train component along the track. The train component further includes a pair of rail guides that engage the opposed sides of the main body of each segment and a spring element connected between the pair of rail guides that operates the switch element when the pair of rail guides engage the opposed sides of the main body.

A toy train system has a track of a plurality of connectable and detachable segments. Each segment includes a main body with an upper running surface that extends continuously across opposed sides and a receiving chamber formed within the main body. Each segment further includes a pair of track members extending outwardly from the opposed sides of the main body and a connector component extending outwardly from the main body opposite the receiving chamber. The connector component includes a necked portion proximate the main body and a distal portion sized larger than an opening of the receiving chamber that engages the receiving chamber and allows movement of each segment in an up-down direction and a side-to-side direction. The toy train system further includes at least one train component that connects to the track for movement thereon. A drive belt of the train component engages the upper running surface. A motor drives the drive belt to move the train component along the track when supplied current from an operated switch element. A pair of rail guides that engage the opposed sides of the main body, and a spring element connected between the pair of rail guides operates the switch element when the pair of rail guides engage the opposed sides of the main body.

DETAILED DESCRIPTION

Figure 1A:
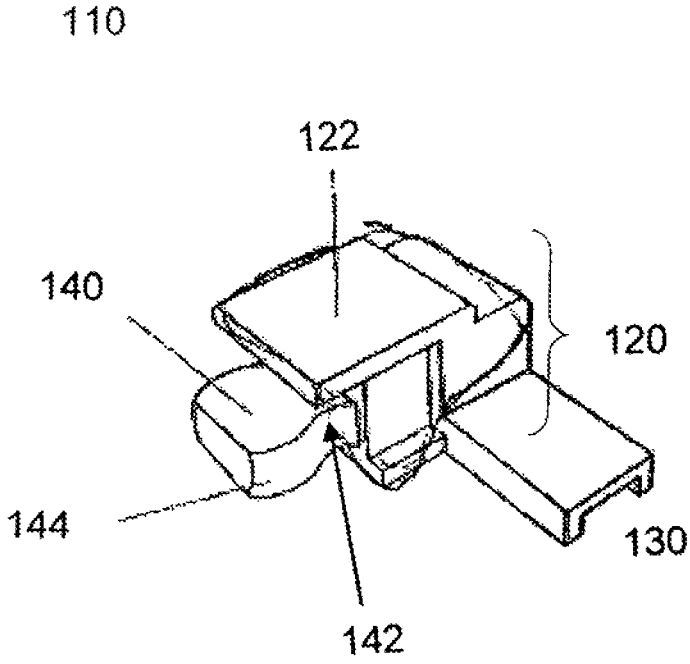
FIG. 1*a* is a perspective view of a track segment.

It will be appreciated that the following description is intended to refer to specific examples of structure selected for illustration in the drawings and is not intended to define or limit the disclosure, other than in the appended claims.

A portable, flexible, and adaptable train system may include a plurality of segments that connect to one another to form a track system. At least one train component may connect to the track system for movement thereon.

FIG. 1*a* is a perspective view of a segment 110 that is used to form a portable, flexible, and adaptable track system. The segment 110 includes a main body 120. The main body 120 has an upper running surface 122 with opposed sides. The upper running surface 122 may extend continuously across the opposed sides. The upper running surface 122 may, alternatively, have a gap or space between its opposed sides.

Figure 1B:
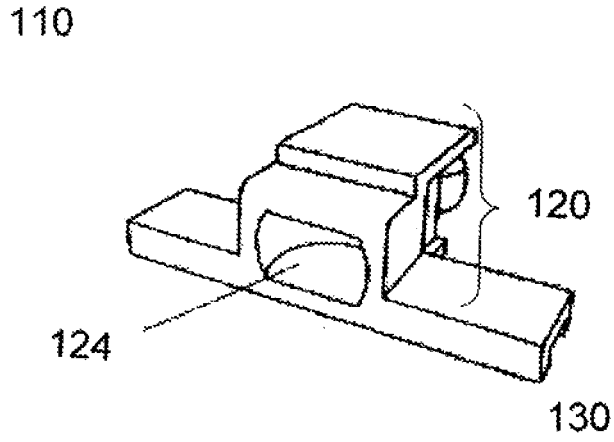
FIG. 1*b* is a second perspective view of the segment of FIG. 1*a*.

FIG. 1*b* is another perspective view of the segment 110. As shown in FIG. 1*b*, a receiving chamber 124 is formed within the main body 120.

The segment 110 further includes a pair of track members 130 that outwardly extend from the opposed sides of the main body 120. The pair of track members 130 provide stability for the track system. It is therefore preferred, but not required, that the segment 110 is rigid.

A connector component 140 outwardly extends from the main body 120 opposite the receiving chamber 124 formed within the main body 120. The connector component 140 has a necked portion 142 that is proximate the main body 120 and a distal portion 144. The distal portion 144 is sized larger than an opening of the receiving chamber 124 and engages the receiving chamber 124 of another segment 110 for up-down and side-to-side movement of the segments 110. The distal portion 144 may be snap-fitted into the receiving chamber 124. The receiving chamber 124 may be curve-shaped, and the distal portion 144 may also have a curved shape. Alternatively, the receiving chamber 124 and the distal portion 144 may be of other shapes and sizes.

Figure 1C:
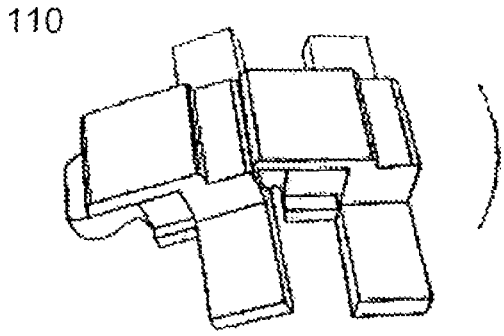
FIG. 1*c* is a perspective view of two segments connected to one another.
Figure 1D:
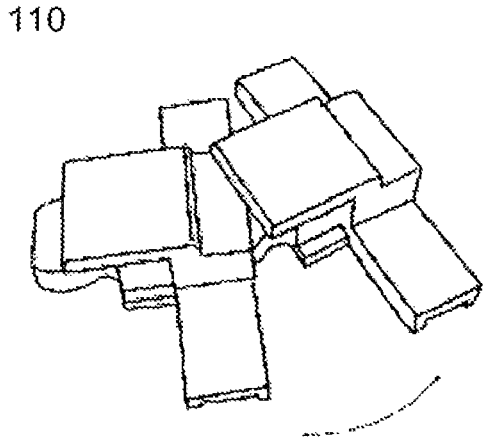
FIG. 1*d* is a second perspective view of the two segments from FIG. 1*c*.

FIG. 1*c* and FIG. 1*d* illustrate two segments 110 connected to one another. The segments 110 are connected by inserting, or snap-fitting, the connector component 140 of a first segment 110 into the receiving chamber 124 of a second segment 110. Once connected, the segments 110 may move in all directions due to a loose fit of the distal portion 144 within the receiving chamber 124. The fit between the distal portion 144 and the receiving chamber 124 defines the amount of movement of the segments 110 relative to one another. A loose fit allows for more movement of the segments 110 than a tight fit allows. FIG. 1*c* demonstrates the movement of the segments 110 in an up-down direction as shown by the arrow, while FIG. 1*d* demonstrates a side-to-side movement as shown by the arrow. The segments 110 are detachable by pulling apart the segments, thereby removing the distal portion 144 of the connector component 140 from the receiving chamber 124.

Figure 1E:
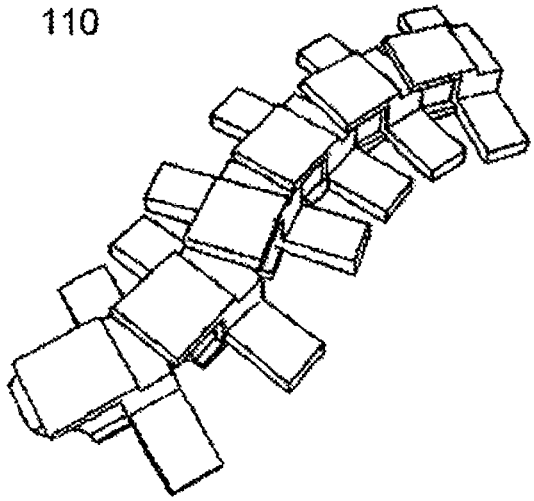
FIG. 1*e* is a perspective view of multiple segments connected to one another.

FIG. 1*e* illustrates multiple segments 110 connected to form a portion of a track system. Each segment 110 is connectable to and detachable from another segment 110. Thus, any number of segments 110 may be used to form a desired length of the track system for the train system. The track system is flexible as the segments 110 may move in an up-down and side-to-side direction relative to one another. Moreover, the track system is portable as the connected segments 110 may be lifted and moved from one surface to another without disturbing the connection between segments 110.

The track system is also adaptable to other tracks or objects. The track system may connect to pre-set track sections through the connector component 140 and/or the receiving chamber 124 of one or more segments 110. The pre-set track sections may be part of larger fixtures. For example, the pre-set track sections may be molded into a tunnel or train station. The track system may also flexibly fit within and/or over various objects. The objects may constrain the direction of the track system. For example, the track system may be placed over a bridge containing side walls that constrain the shape of the track system. Also, the shape of the track system is such that segments can be embedded in accessories and playsets such as bridges, stations and the like.

Figure 2A:
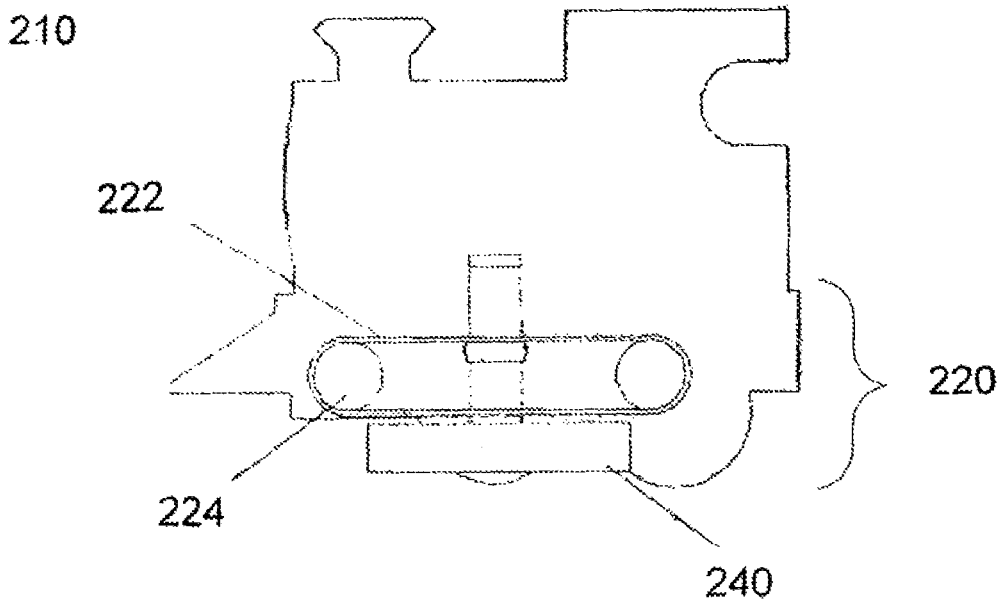
FIG. 2*a* is a schematic side view of a train component.

FIG. 2*a* is an illustration of a side view of a train component 210 that connects to the track system for movement thereon. The train component 210 includes a drive member 220 that engages the upper running surface 122 of the segments 110. The drive member 220 may include a drive belt 222, a pair of pulleys 224, and rail guides 240.

Figure 2B:
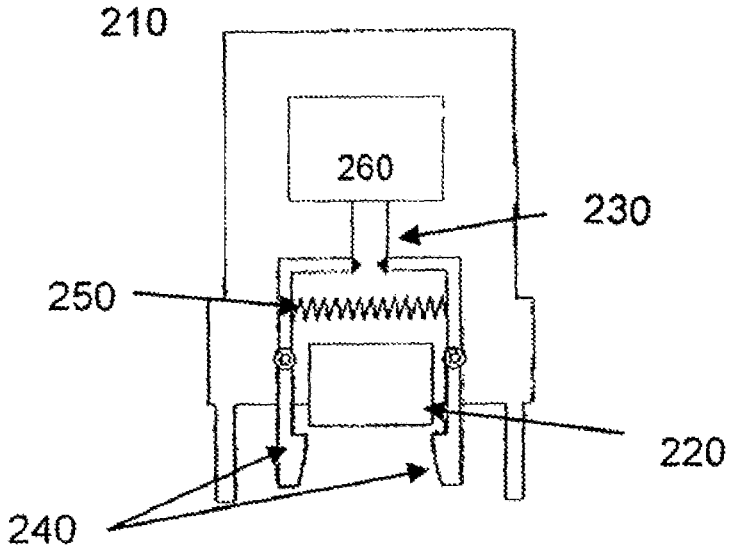
FIG. 2*b* is a schematic front sectional view of a train component.

FIG. 2*b* is a front sectional view of the train component 210. The train component 210 further includes a switch element 230 that drives the drive member 220 to move the train component 210 along the track system. A pair of rail guides 240 engage the opposed sides of the main body 120. A spring element 250 is connected between the rail guides 240 and operates the switch element 230 when the rail guides 240 engage the opposed sides of the main body 120. A motor 260 drives the drive member 220. The switch element 230, when operated, supplies current to the motor 260 to drive the drive member 220.

Figure 2C:
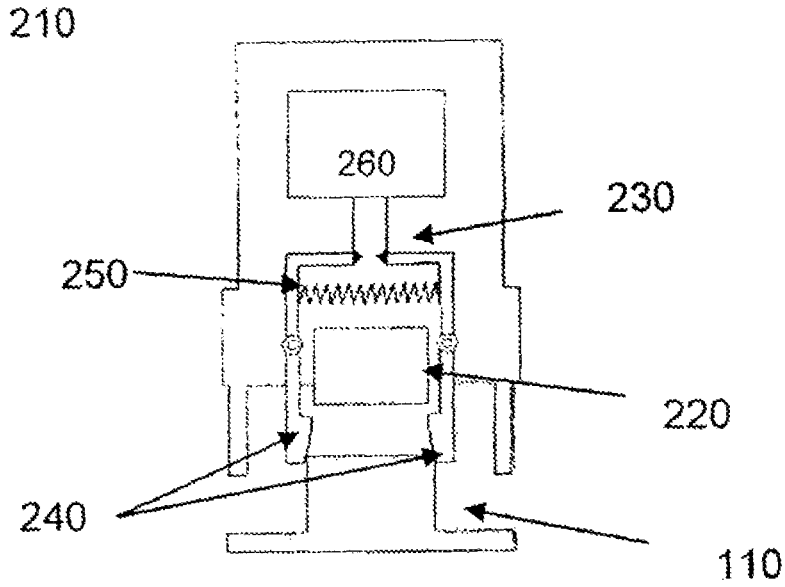
FIG. 2*c* is a front sectional view of a train component positioned over a segment.
Figure 2D:
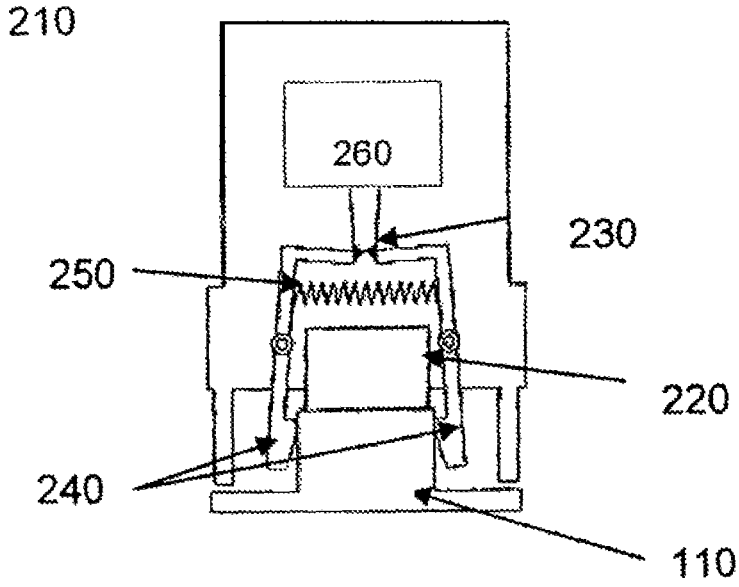
FIG. 2*d* is a front sectional view of a train component positioned on a segment.

FIGS. 2*c* and 2*d* illustrate the connection of the train component 210 to the track system from a front sectional view. As shown in FIG. 2*c*, the train component 210 is aligned with the track system. In particular, the rail guides 240 are aligned with the opposed sides of the main body 120 of a segment 110. At this point, the switch element 230 is not operated.

As shown in FIG. 2*d*, the train component 210 is pushed downwardly onto the track system. In particular, as the rail guides 240 are aligned with the opposed sides of the main body 120 and the train component 210 is pushed down onto the track system, the rail guides 240 are forced apart. The spring element 250 provides pressure to the pair of rail guides 240 to secure the train component 210 to the upper running surface 122 of the track system. As the rail guides 240 engage the opposed sides of the main body 120 and are secured to the upper running surface 122, the spring element 250 operates the switch element 230. The switch element 230 supplies current to the motor 260. The motor 260 drives the drive member 220. The drive belt 222 is in contact with the upper running surface 122 and drives the train component 210 along the track system.

Multiple train components 210 may be connected to one another and may be connected to the track system as described above. All or only a portion of the train components may contain a drive system. The one or more train components 210 may align the flexible track system when running along the upper running surfaces 122 of a plurality of connected segments 110. For example, as each segment 110 may move in an up-down and side-to-side direction relative to one another, the train components 210 running along the track system align the segments 110. In this manner, if the segments 110 are moved in relation to one another so that the segments 110 have formed a misaligned track system, the train components 210 may align the segments 110 and continue to move along the track system.

While in the foregoing detailed description of this disclosure has been described in relation to certain representative structures thereof, and many details have been set forth for purposes of illustration, it will be apparent to those skilled in the art that the disclosure can be varied considerably without departing from the basic principles of the disclosure.

The invention claimed is:

1. A toy train system, comprising: a track comprised of a plurality of segments that connect to and detach from one another, each segment comprising: a main body comprising an upper running surface with opposed sides and a receiving chamber formed within the main body; a pair of track members extending outwardly from the opposed sides of the main body; and a connector component extending outwardly from the main body opposite the receiving chamber, comprising a necked portion proximate the main body and a distal portion sized larger than an opening of the receiving chamber that engages the receiving chamber and allows movement of each segment in an up-down direction and a side-to-side direction; at least one train component that connects to the track for movement thereon, the at least one train component comprising: a drive member that engages the upper running surface; and a pair of rail guides configured to apply pressure to the opposed sides of the main body.

2. The toy train system of claim 1, wherein the receiving chamber comprises a curved shape into which the connector component is snap-fitted, and wherein the distal portion of the connector component is curved.

3. The toy train system of claim 1, wherein the drive member comprises a drive belt and a pair of pulleys.

4. The toy train system of claim 1, further comprising a spring element connected between the pair of rail guides that operates the switch element when the pair of rail guides engage the opposed sides of the main body.

5. The toy train system of claim 4, wherein the spring element provides pressure to the pair of rail guides to secure the at least one train component to the upper running surface.

6. The toy train system of claim 1, further comprising a switch element that when operated drives the drive member to move the at least one train component along the track.

7. The toy train system of claim 6, further comprising a motor that drives the drive member, wherein the switch element supplies current to the motor.

8. The toy train system of claim 1, wherein the at least one train component aligns the track for movement thereon by running along the upper running surface of a plurality of segments connected to one another.

9. The toy train system of claim 1, wherein the track, comprised of a plurality of segments connected to one another, connects to pre-set track sections.

10. The toy train system of claim 1, wherein the track, comprised of a plurality of segments connected to one another, flexibly fits within and/or over one or more objects.

11. The toy train system of claim 10, wherein the one or more objects directionally constrain the track.

* * * * *